US006776262B2

(12) United States Patent
Hur

(10) Patent No.: US 6,776,262 B2
(45) Date of Patent: Aug. 17, 2004

(54) OIL FEEDING DEVICE FOR VEHICLES

(75) Inventor: Young Hur, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/106,584

(22) Filed: Mar. 25, 2002

(65) Prior Publication Data

US 2003/0037992 A1 Feb. 27, 2003

(30) Foreign Application Priority Data

Aug. 21, 2000 (KR) ..... 2001-50396

(51) Int. Cl.[7] ..... F16N 31/00
(52) U.S. Cl. ..... 184/106; 123/196 R
(58) Field of Search ..... 184/6.2, 103.1, 184/103.2, 105.3, 106, 6.5, 6.12; 123/196 A, 196 R, 196 S

(56) References Cited

U.S. PATENT DOCUMENTS 4,134,380 A 1/1979 Niwa et al.
4,296,716 A * 10/1981 Hofbauer et al. ..... 123/195 C
4,352,737 A 10/1982 Taniguchi
4,449,493 A 5/1984 Kopec et al.
4,909,203 A 3/1990 Fukuo
5,168,845 A * 12/1992 Peaker ..... 123/196 S
5,190,120 A 3/1993 Watts
5,566,781 A 10/1996 Robert et al.
5,960,763 A 10/1999 Yamamura
5,971,719 A 10/1999 Takeuchi
6,189,501 B1 2/2001 Fujii et al.
6,234,136 B1 * 5/2001 Choi et al. ..... 123/195 C
6,289,865 B1 * 9/2001 Spix ..... 123/196 R
2001/0037788 A1 * 11/2001 Okuda et al. ..... 123/195 C
2002/0096221 A1 * 7/2002 Kapcoe et al. ..... 137/590

FOREIGN PATENT DOCUMENTS

WO PCT/EP99/10361 * 7/2000

* cited by examiner

*Primary Examiner*—David Fenstermacher
(74) *Attorney, Agent, or Firm*—Morgan Lewis & Bockius LLP

(57) ABSTRACT

An oil feeding device for vehicles is disclosed. This oil feeding device is designed to draw oil from an oil pan through a plurality of suction branch pipes placed in depressions formed at the corners of the oil pan's bottom. Therefore, the oil feeding device reliably feeds a desired quantity of lubrication oil from the oil pan to the desired parts of a vehicle, such as the parts of a transmission, even when the oil level inside the oil pan is below a predetermined level due to consumption of oil, or excessive incline by the leaning of oil to one side due to inclination of a vehicle running on a slope.

4 Claims, 3 Drawing Sheets

OIL FEEDING DEVICE FOR VEHICLES

FIELD OF THE INVENTION

The present invention relates to oil feeding devices for vehicles and, more particularly, to an oil feeding device for vehicles designed to reliably feed a desired quantity of lubrication oil to desired parts of the vehicle regardless of variation in the oil level in an oil pan.

BACKGROUND OF THE INVENTION

As well known to those skilled in the art, it is necessary to lubricate the junctions of movable contact parts in a vehicle engine or transmission to reduce frictional resistance of the parts, in addition to cooling them. In order to lubricate such parts, lubrication oil is fed from an oil pan to desired parts of the engine and transmission. Such parts include a valve body, a clutch, planetary gears and an output gear. Oil is circulated by a pumping operation of an oil feed pump, thus cooling the parts and allowing a smooth movement between parts.

The construction of a conventional oil feeding device for supplying oil to the movable contact parts of a transmission in a vehicle is shown in FIG. 1. As shown in the drawing, the conventional oil feeding device has an oil pan 1 provided at the bottom of a casing 4. An oil feed pipe 6 extends from the oil pan 1, with an oil feed pump 2 mounted to the pipe 6. When the pump 2 is operated, oil "O" under pressure flows from the oil pan 1 to the desired parts of the transmission through the oil feed pipe 6 so as to lubricate parts of the engine and transmission. The oil feed pipe 6 is also provided with an oil filter 3 for filtering the oil flowing through the pipe 6, thus removing impurities from the oil. An oil screen 5 is provided at the inlet end of the oil feed pipe 6 such that it is sunk into the oil inside the oil pan 1. The oil screen 5 screens the oil to exclude impurities before the oil flows into the oil feed pipe 6.

When the oil feed pump 2 draws oil from the oil pan 1 during operation of the transmission, large-sized impurities are primarily removed from the oil by the oil screen 5 before the oil is introduced into the oil feed pipe 6. The primarily filtered oil passes through the pipe 6, and is secondarily filtered by the oil filter 3 prior to reaching the desired parts of the engine and transmission.

However, the conventional oil feeding device can be problematic in that when the oil level inside the oil pan 1 is below the oil screen 5 due to consumption of oil, or when the oil leans to one side due to inclination of a vehicle running on a slope, a sufficient quantity of oil is not fed from the oil pan to the desired parts of the engine or transmission. In such a case, the oil feeding device fails to effectively provide lubrication.

SUMMARY OF THE INVENTION

The present invention provides an oil feeding device for vehicles, which is designed to reliably feed a desired quantity of lubrication oil to the movable contact parts of a vehicle, such as parts of the engine or transmission. The present invention provides necessary lubrication even when the oil level inside the oil pan is below a predetermined level due to consumption of oil or excessive incline due to inclination of a vehicle running on a slope.

According to a preferred embodiment of the invention, an oil pump for drawing oil from an oil pan is provided at the bottom of the casing, feeding the oil to the desired parts of a vehicle through an oil feed pipe. An oil filter for removing impurities from the oil is also provided along the feed pipe. A preferred embodiment the invention further comprises a guider connected to the oil inlet end of the oil feed pipe inside the oil pan and drawing oil from the oil pan at several positions.

In an alternative embodiment of the invention, an oil pan configured to contain oil communicates with an oil feed tube. An oil pump positioned along the feed tube draws oil from the oil pan. An oil screen is positioned in the feed tube between the oil pan and oil pump. Plural branch members are formed on the oil feed tube wherein each branch member opens into a specific area of said oil pan, with this arrangement a continuous supply of oil from the pan to the tube may be facilitated in spite of variations of oil levels within the pan. Preferably there are four such branch members, and each branch member opens approximately in a comer of the oil pan. In a further preferred embodiment, the oil pan defines a plurality of depressed areas, wherein each depressed area is associated with an opening of one of the the plural branch members. More preferably each opening of a branch member includes a sub-filter and each sub-filter incorporates a shock absorber acting between the branch member and oil pan.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
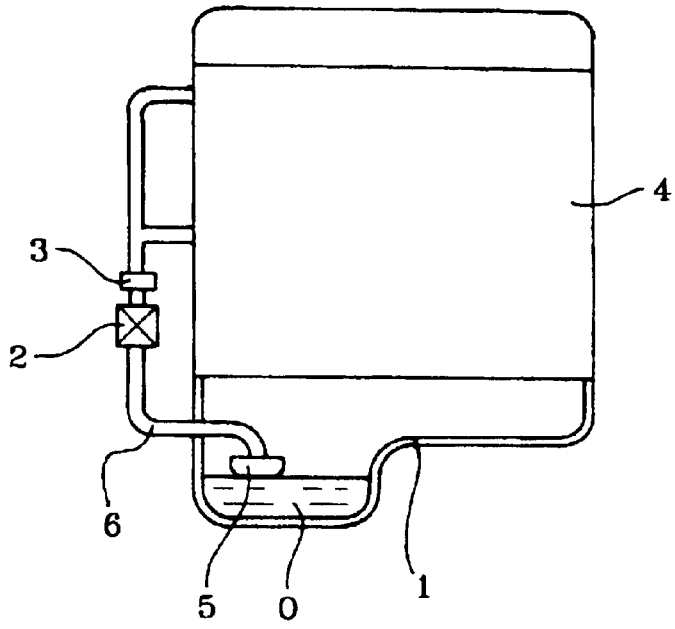
FIG.1 (Prior art)
FIG. 1 is a schematic side view showing the construction of a conventional oil feeding device for vehicles.

Reference now should be made to the drawings, in which the same reference numerals are used throughout the different drawings to designate the same or similar components.

Figure 2:
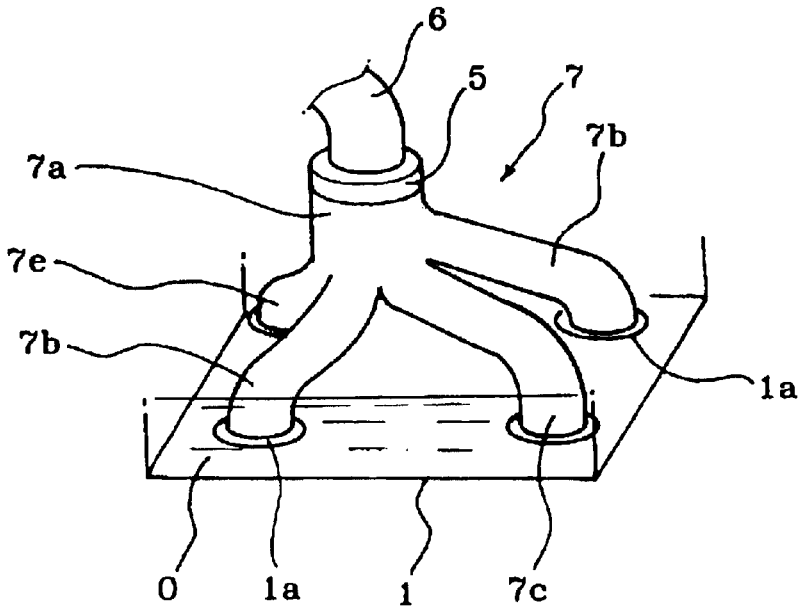
FIG. 2 is a perspective view of an oil suction unit of an oil feeding device for vehicles in accordance with the present invention.

As shown in FIG. 2, an oil suction unit according to the invention comprises a guider 7, which is connected to the inlet end of an oil feed pipe 6 inside an oil pan 1 and is designed to draw oil from the oil pan 1 at several positions. In the same manner as that described for the conventional device of FIG. 1, the oil pan 1 is provided at the bottom of a casing 4. In addition, the oil feed pipe 6 has an oil feed pump 2, which generates a suction force for forcibly drawing oil from the oil pan 1 into the oil feed pipe 6 through the guider 7. The oil, introduced into the pipe 6, passes through an oil filter 3 prior to reaching the parts of the engine or transmission.

The guider 7 consists of a coupling part 7*a*, at which the guider 7 is coupled to the oil screen 5 of the oil feed pipe 6. A plurality of suction branch pipes 7*b*, 7*c*, 7*d* and 7*e* commonly extend from the coupling part 7*a*, and are placed at their ends inside a plurality of depressions 1*a* formed at the corners of the bottom of the oil pan 1 as shown in FIG. 6. The suction branch pipes 7*b*, 7*c*, 7*d* and 7*e* of the guider 7 have the same construction, and so only the first branch pipe 7*b* is shown as an example of various alternative embodiments in FIGS. 3, 4 and 5.

Figure 3:
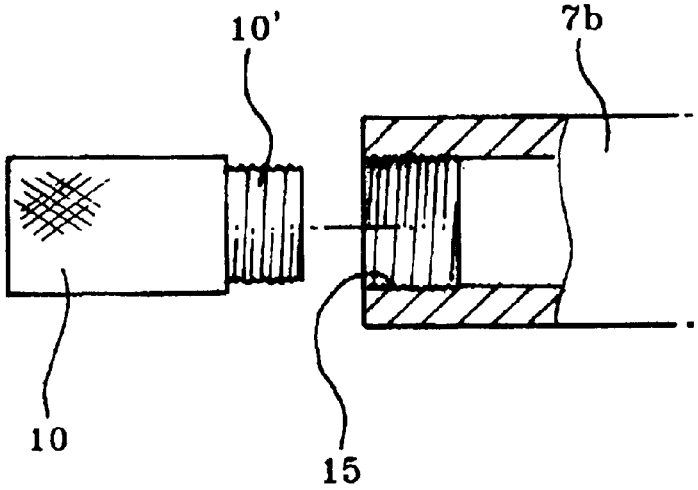
FIG. 3 is a partial cross-sectional view showing the construction of an oil suction unit, with branch pipes each having a detachable sub-filter according to an embodiment of this invention.
Figure 4:
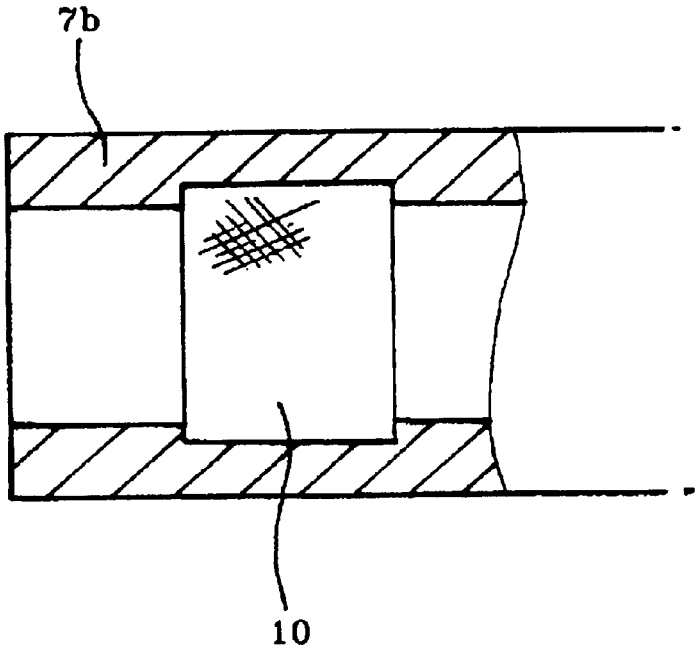
FIG. 4 is a cross-sectional view showing the construction of an oil suction unit, with branch pipes each having a fixed sub-filter according to another embodiment of this invention.

As shown in FIG. 3, the branch pipe 7*b* may be provided with internal threads 7*b*' at its end, while the sub-filter 10 has external threads 10'. The sub-filter 10 is thus detachably mounted to the end of the branch pipe 7*b* through a screw-type engagement. In an alternative embodiment of the invention, the sub-filter 10 is fixedly set in the end of the branch pipe 7*b* as shown in FIG. 4. In a further alternative embodiment, the sub-filter 10 is coupled to the end of the branch pipe 7*b* using a movable member 11 such that the position of the sub-filter end relative to the branch pipe end may be changeable as shown in FIG. 5.

Figure 5:
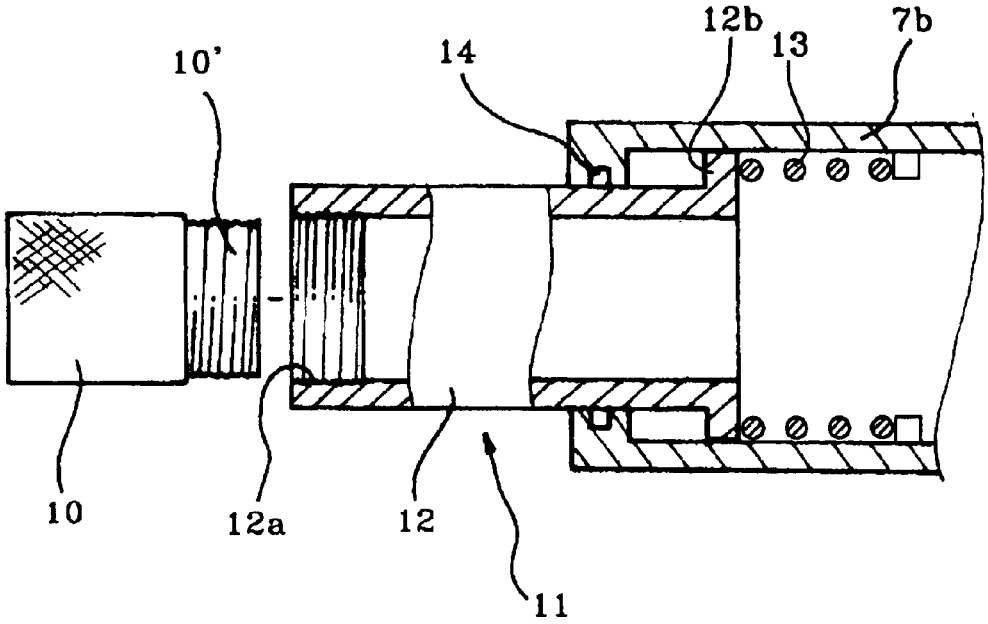
FIG. 5 is a partial cross-sectional view showing the construction of an oil suction unit, with branch pipes each connected to a sub-filter through a movable member according to a further embodiment of this invention.
Figure 6:
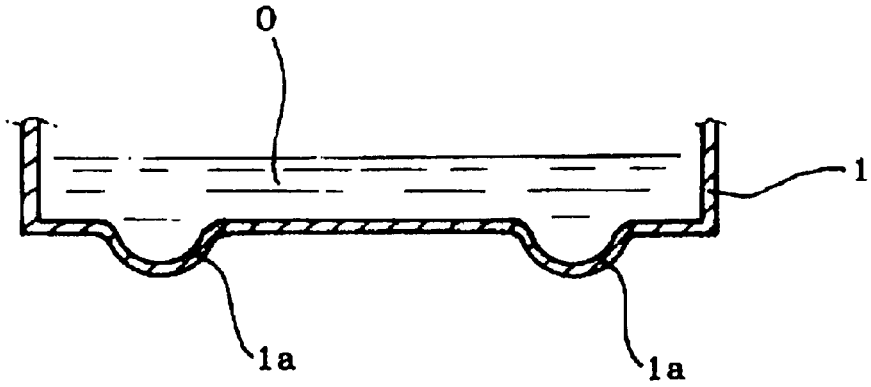
FIG. 6 is a sectional view, showing the shape of the bottom of the oil pan included in the oil feeding device of this invention.

In the guider 7 according to the embodiment of FIG. 5, the movable member 11 is a tubular shock absorber 12, which is inserted into the end of the branch pipe 7*b* and has a flange 12*b* at its inside end. A coil spring 13 is set in the annular gap between the branch pipe 7*b* and the shock absorber 12, and is connected at both its ends to the branch pipe end and the flange 12*b*. In addition, the shock absorber 12 is also provided with internal threads 12*a* at its outside end, while the sub-filter 10 has external threads 10'. The sub-filter 10 is thus detachably mounted to the end of the shock absorber 12 through a screw-type engagement. In this embodiment, a sealing ring 14 is provided at the junction of the cylindrical outer wall of the tubular shock absorber 12 and the end of the branch pipe 7*b*, thus accomplishing a sealing effect at the junction.

The oil feeding device for vehicles according to the present invention operates as follows:

When the transmission is operated, the oil feed pump 2 generates suction force for feeding lubrication oil from the oil pan 1 to parts of the engine or transmission. That is, the oil feed pump 2 is operated, the oil contained in the oil pan 1 is first drawn into the coupling part 7*a* of the guider 7 through the suction branch pipes 7*b*, 7*c*, 7*d* and 7*e*. The suction branch pipes have the sub-filters 10 at their ends and are placed inside the depressions 1*a* of the oil pan 1. Thereafter, the oil passes through the oil screen 5, the oil pump 2 and the oil filter so as to be fed to the desired parts of the engine or transmission.

During operation of the oil feeding device, the oil level inside the oil pan 1 may be below the oil screen 5 due to consumption of oil, or the oil screen 5 may be exposed outside of the oil when the oil runs to one side due to inclination of the vehicle running on a slope, or due to inertial force applied to the oil pan 1 in the case of a quick start or stop of the vehicle. However, even in the above-mentioned case, the oil feeding device of this invention reliably feeds oil from the oil pan 1 to the desired parts of the transmission since the oil in the oil pan 1 is drawn by the suction branch pipes 7*b*, 7*c*, 7*d* and 7*e* of the guider 7 placed at their ends inside the depressions 1*a*, which are formed at the comers of the bottom of the oil pan 1 and are filled with oil.

When a sub-filter 10 is mounted to each of the branch pipes 7*b*, 7*c*, 7*d* and 7*e* of the guider 7 through a spring-biased movable member 11 as shown in FIG. 5, it is possible for the guider 7 to smoothly absorb external shock by the movable members 11 and springs 13, even when external shock is applied from the oil pan 1 to the ends of the branch pipes 7*b*, 7*c*, 7*d* and 7*e*.

In the above description of preferred embodiments of the invention, the oil feeding device is used with a transmission of a vehicle. However, it should be understood that the oil feeding device of this invention may be preferably used with other parts of a vehicle, such as an engine having an oil pan at its casing bottom and drawing oil from the oil pan using an oil feed pipe, without affecting the functioning of this invention.

As described above, the present invention provides an oil feeding device for vehicles. This oil feeding device draws oil from an oil pan through a plurality of suction branch pipes placed in depressions formed at the comers of the oil pan bottom. Therefore, the oil feeding device reliably feeds a desired quantity of lubrication oil to movable contact parts of a vehicle, such as the parts of an engine or transmission, even when the oil level inside the oil pan is below a predetermined level due to consumption of oil, or excessive inclination of the vehicle.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An oil feeding device for vehicles, comprising a guider, connected to an oil inlet end of an oil feed pipe inside an oil pan and drawing oil from said oil pan at several positions, wherein said guider has branch pipes, each branch pipe having a movable member interposed between each branch pipe and the oil pan as a shock absorber, wherein said guider comprises:

a coupling part, at which said guider is coupled to an oil screen of said oil feed pipe; and a plurality of suction branch pipes commonly extending from said coupling part, and placed at ends thereof inside a plurality of depressions formed at corners of a bottom of said oil pan, wherein each of said branch pines of the guider has internal threads at the end thereof, and is assembled with a sub-filter at the internal threads through a screw-type engagement, wherein the sub-filter is coupled to the end of each branch pipe using a movable member, and wherein said movable member is inserted into the end of each branch pipe and has a flange at an inside end thereof, with a spring set in an annular gap between the branch pipe and the shock absorber, said shock absorber having internal threads at an outside end thereof and assembled with the sub-filter at said external threads through a screw-type engagement.

2. An oil feeding system for vehicles, comprising an oil pan configured to contain oil, wherein said oil pan defines a plurality of depressed areas;

an oil feed tube communicating with said oil pan;

an oil pump positioned along the feed tube to draw oil from said oil pan;

an oil screen positioned in said feed tube between the oil pan and oil pump; and plural branch members formed on the oil feed tube wherein each branch member opens into a separate area of said oil pan at one of said depressed areas, wherein each said opening of a branch member includes a sub-filter, and each said sub-filter incorporates a shock absorber acting between the branch member and oil pan, whereby continuous supply of oil from the pan to the tube may be facilitated in spite of variations of oil levels or inclinations within the pan.

3. The oil feed system according to claim 2, wherein said plural branch members comprise four branch members.

4. The oil feed system according to claim 3, wherein each said branch member opens approximately in a corner of the oil pan.

* * * * *